United States Patent [19]

Boyle

[11] 4,128,272

[45] Dec. 5, 1978

[54] MULTI-SEGMENTAL CUSHION ASSEMBLY FOR ADAPTING CONTOUR DENTAL CHAIRS TO A CHILD'S PHYSIQUE

[76] Inventor: Danny P. Boyle, 855 E. Brown Rd., Mesa, Ariz. 85203

[21] Appl. No.: 856,399

[22] Filed: Dec. 1, 1977

[51] Int. Cl.[2] ..... A47C 7/02

[52] U.S. Cl. ..... 297/231; 5/327 B; 297/284; 297/391; 297/455

[58] Field of Search ..... 5/327 R, 327 B, 338, 5/344, 345 R, 352; 297/230–232, 284, 391, 394, 396, 397, 454–456

[56] References Cited

U.S. PATENT DOCUMENTS

| | | | |
|---|---|---|---|
| 3,073,649 | 1/1963 | Montfort | 297/454 X |
| 3,207,555 | 9/1965 | Kerr | 297/408 X |
| 3,707,008 | 12/1972 | Fellin et al. | 5/345 R |

*Primary Examiner*—James C. Mitchell

*Attorney, Agent, or Firm*—Cahill, Sutton & Thomas

[57] ABSTRACT

A multi-segmented cushion assembly, positionable upon a contoured dental chair, supports a child at the proper height with respect to the dentist and maintains the head of the child tilted back while precluding side-to-side movement of the head. By being segmented, the cushion assembly can be altered in plan form to accommodate a range of torso lengths of young children and yet provides a feeling of comfort and security to the children.

12 Claims, 6 Drawing Figures

MULTI-SEGMENTAL CUSHION ASSEMBLY FOR ADAPTING CONTOUR DENTAL CHAIRS TO A CHILD'S PHYSIQUE

The present invention relates to dental chairs and, more particularly, to a cushion assembly for adapting a contour dental chair to a child's physique.

Contoured dental chairs have been developed for two primary purposes. First, the contour dental chair provides a comfortable semi-reclining support for an adult. By being comfortable, the contour dental chair tends to relax the adult and it has the further psychological benefit of creating an aura of security to reduce feelings of anxiety. Second, the configuration of a contour dental chair provides many physical benefits, including the following. It places the mouth of the adult in a nearly ideal position for the dentist. That is, the head is tilted back such that the mouth points upwardly and is in a position where it can be easily opened and held open by the adult. Moreover, the dentist's vision into the mouth and his access to the teeth is excellent. Proper position of the adult's head in a contour dental chair has the further effect of allowing the base of the tongue to drop down and seal off the trachea and esophagus from water spray; thereby, the adult's tendency to choke or expectorate is reduced or eliminated. The narrowness of the upper part of the chair supporting the head renders the application of nitrous oxide more facile in that the narrow width, adjacent to which the nitrous oxide and oxygen hoses pass, tends to maintain the hoses in general rearward alignment with the point of application, the nostrils. And, distortion of the nose piece along with the accompanying misdirection of nitrous oxide and oxygen is eliminated.

Necessarily, a dental contour chair is constructed to accommodate a certain sized physique; greater or lesser sized physiques, up to a certain degree of deviation, are acceptably accommodated. However, the physiques of children are out of the range of physiques accommodatable by a contour dental chair, such that the benefits thereof are not present. Since children often begin periodic checkups at age three and are often no more than three feet tall at this age, the contour dental chair is of no more benefit to them than any other dental chair.

When children expecially ages seven or less, are seated in an upright or semi-reclining position in a dental chair, several disadvantages to both the child and the dentist exist. Young children generally have a rearwardly extending cranium such that when the back of their heads and their backs are adjacent a relatively planar surface, their head is forced to tilt forwardly and downwardly. This downward tilting of the head makes it difficult to open the mouth. Moreover, both visual and physical access to the mouth is only possible thru extreme contortions by the dentist, rendering the work to be performed exceptionally difficult. Young children also have a bump on the back of their head which, when resting against a planar surface, tends to cause their heads to rotate sideways. Such a tendency for side rotation of the head makes it more difficult for the child to maintain his head at an orientation preferred by the dentist and continual repositioning of the head to the preferred position has a tendency of harrassing the child and promoting crankiness. The lack of a secure and comfortable feeling on being rested in a contoured dental chair is absent, which absence tends to promote feelings of insecurity in the child and the child may become frightened to the point where further dental work is impossible. A combination of nitrous oxide and oxygen is often administered thru a nosepiece attached to the nostrils of young children in an effort to keep them calm and render the dental visit at least a non-frightening experience. Since the hoses for administering these gases extend from the child's nose rearwardly behind the back of the chair, the hoses must extend laterally from the nose about the normally greatest width of the back of the chair. The lateral extension of these hoses, in combination with their weight, tends to exert sufficient lateral force upon the nosepiece to at least partially dislodge it and negatively affect the adminstration of the gases.

In 1879, as evidence by U.S. Pat. No. 215,075, the need for raising a child in a dental chair to render the child's mouth more accessible to a dentist was recognized. The then existing solution to the problem was that of providing a removable cushion supported upon the arm rests of a dental chair. A similar effect of raising a child patient was achieved by a dental chair described in U.S. Pat. No. 1,157,351 wherein the backrest included a forwardly pivotable portion convertible to a seat for the child. A booster seat, including arm rests, for placement upon a dental chair was taught in U.S. Design Pat. No. 191,513. Other booster seats for children useable in barber chairs or positionable upon automobile seats are described in U.S. Design Pat. No. 69,243 and U.S. Pat. No. 2,337,480, respectively.

The primary purpose of the known prior art devices for accommodating children in full-sized dental chairs is directed to one and only one problem. That is, to boost or raise a child to a sufficient height so that the dentist need not assume an extreme bent-over posture in order to perform work upon the child's teeth. The prior art neither suggests nor teaches solutions to the above enumerated physical and phychological considerations attendant the performance of dental work upon children of an age old enough to visit a dentist.

In the preferred embodiment of the present invention, a multi-segmented cushion assembly is positionable upon and supported by a contour dental chair it is configured proportional to the height of a child and generally conforms to the contour of the dental chair. By the addition or removal of one or more of the back support segments, conformation with the torso length of the child is obtained. A headpiece at the top of the back support segments urges the child's head to tilt up and back to place the child's mouth in a visually and physically preferred position for the dentist; additionally, the head rest laterally supports the child's head to preclude unwanted sideways rolling of the head. The width of the back support segments of the assembly are equal to or less than the width of the corresponding section of the contour dental chair to thereby eliminate unnecessary lateral force upon hoses supplying nitrous oxide and oxygen to a nosepiece attached to the child's nostrils. A seat segment of the assembly raises the child to a height confortable to the dentist and eliminates the fatigue attendant an extreme bent-over position by the dentist. A leg support segment of the assembly supports the child's legs and feet with the cumulative effect, in combination with the other segments of the assembly, of providing comfortable continuous support of the child. By insuring that the child is comfortable, problems attendant any feelings of insecurity and exacerbation of any underlying fright the child may have are avoided or eliminated. The psychological effect created by the child's sense of security encourages the child to cooperate in full with the dentist.

It is therefor a primary object of the present invention to adapt a full sized contour dental chair to the physique of a child.

Another object of the present invention is to provide a segmented cushion assembly for use in a contour dental chair.

Still another object of the present invention is to provide comfortable full-length semi-reclining support for a child in a dental chair.

Yet another object of the present invention is to provide a segmented cushion assembly for use in a dental chair which tilts a child's head upward and backwards.

A further object of the present invention is to provide a segmental cushion assembly which prevents side-to-side head movement of a child seated within a contour dental chair.

A still further object of the present invention is to provide a multi-segmented cushion assembly conformable to various torso lengths of children.

A yet further object of the present invention is to provide a segmental cushion assembly for raising the height of a child within a semi-reclined contour dental chair.

These and other object of the present invention will become apparent to those skilled in the art as the description thereof proceeds.

The present invention may be described with greater specificity and clarity with reference to the following drawings, in which.

Figure 1:
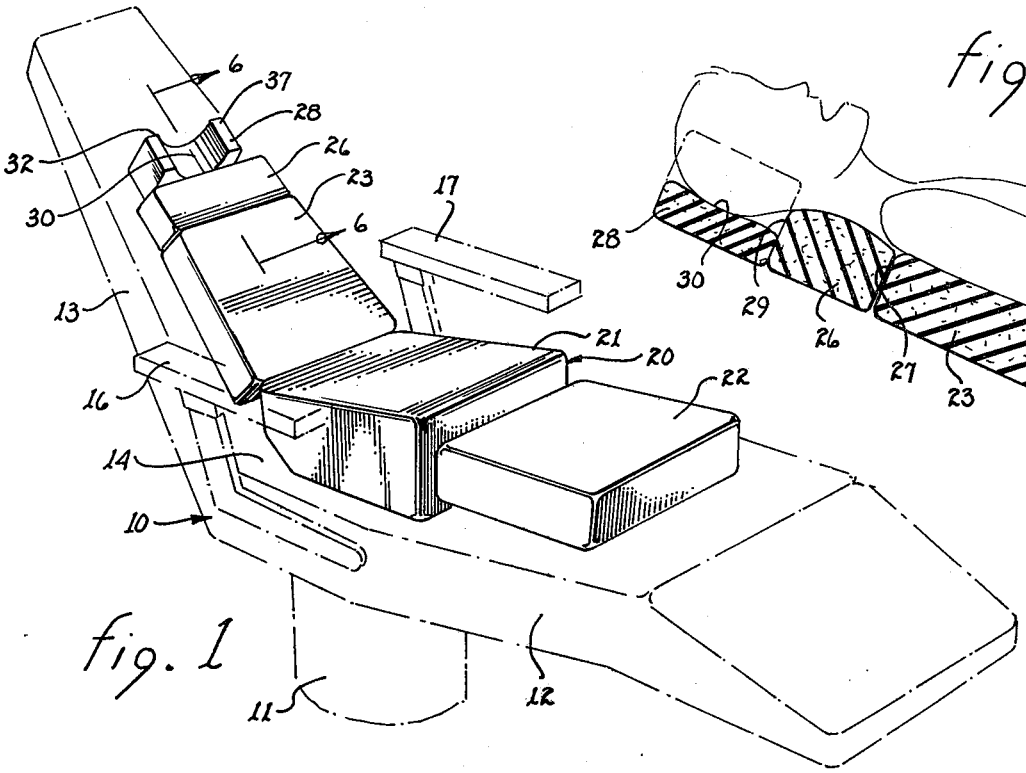
FIG. 1 is a perspective view of a conventional contour dental chair having a multi-segmented cushion assembly positioned thereupon.
Figure 6:
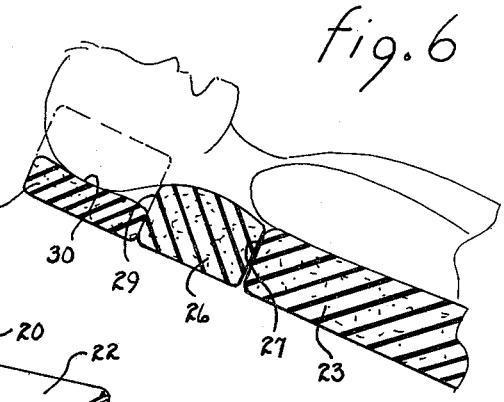
FIG. 6 is a cross-sectional view taken along lines 6—6, as shown in FIG. 1.

As shown in FIG. 1, a conventional contour dental chair 10 is normally mounted upon a pedestal 11. The pedestal includes apparatus for pivoting the dental chair about a vertical axis and further apparatus for vertically positioning the dental chair within certain predetermined limits. The dental chair itself includes a seat and leg support section 12 and a back and head support section 13. These two sections may be pivotable with respect to one another at a pivot point 14 generally commensurate with their junction point. Arm rests 16 and 17, which may be movable or pivotable out of the way, extend upwardly from section 12.

The contour dental chair was developed to provide the benefits not achievable by the earlier and more conventional dental chairs. That is, the contour dental chair continuously supports the full length of the patient in a semi-reclining position. This position is very comfortable and the patient is immediately placed at ease, which provides certain psychological benefits. The back and head support section of the contour dental chair is configured to so position the head that the patient is encouraged to open his mouth and the head is urged to tilt back sufficiently to improve the dentist's vision into the mouth and increase the dentist's accessibility to the teeth.

When a child is placed in an adult sized contour dental chair, whether or not sitting upon a cushion or booster seat, the surface of the back and head support section forces the child's head to tilt forwardly and downwardly because of the rearwardly extending section of his cranium. In this position, the child has difficulty opening his mouth; visibility into the mouth, as well as access to the teeth, are severely restricted. Moreover, because of the conformation of the contour dental chair, a child has a tendency to slide downwardly which further exacerbates the problems of visibility and access to the oral cavity.

Figure 2:
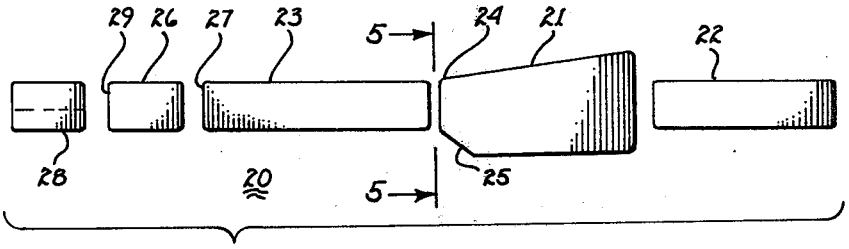
FIG. 2 is an exploded view of the segmental cushion assembly.
Figure 3:
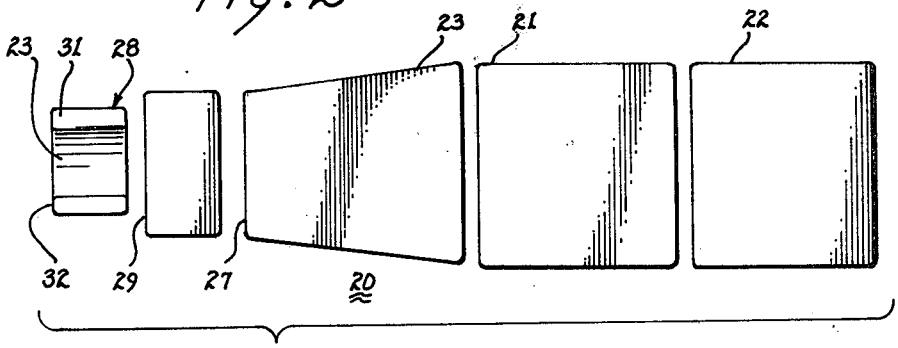
FIG. 3 is an exploded view of the segmental cushion assembly.

The multi-segmented cushion assembly, generally identified by the numeral 20, will be described with joint reference to FIGS. 1, 2 and 3. Seat cushion 21 supports the buttocks and upper thighs of the child at a height of several inches above the underlying seat portion of section 12 of the dental chair. Thus, the child is elevated to a position at which the dentist can comfortably perform his work. The top surface of the seat cushion may be inclined downwardly toward back and head support section 13 to counter any tendency of the child to slide forwardly. In fact such an incline tends to urge the child toward the back and head section.

Figure 5:
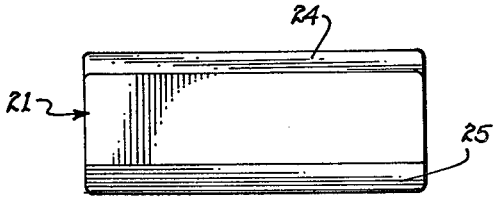
FIG. 5 is an end view taken along lines 5—5, as shown in FIG. 2.

Seat cushion 21 includes a chamfered or angled surface 24 (for reasons discussed below) and chamfered or angled surface 25, as shown in FIG. 5. Surface 25 is incorporated to avoid an interfering relationship with the junction between sections 12 and 13 of the dental chair. Thus, seat cushion 21 will not be readily repositioned or dislodged because of an interfering fit with the junction; nor will it be readily dislodged because of any changes in angular orientation between sections 12 and 13.

The seat cushion is of somewhat lesser width than underlying section 12 as young childrens' buttocks are substantially more narrow than those of grownups. This has a psychological effect of personalizing the dental chair environment and adds a certain sense of security to soothe and relax the child.

Leg cushion 22 supports the legs and feet of the child. The thickness of the leg cushion is somewhat less than that of the seat cushion whereby the child's knees are slightly bent at a comfortable and relaxing angle.

Back cushion 23 rests upon the upper surface 24 of the seat cushion. The employment of angle surface 24 tends to aid in supportingly maintaining the back cushion in place with respect to the seat cushion. The length of the back cushion is selected to support the child's back from a point at the lower back to the shoulder blades. The width of the back cushion is purposely less than that of the width of section 13 of the contour dental chair and generally conforms with the width of the child's torso.

A neck cushion 26 rests upon upper edge 27 of back cushion 23 and is supported upon section 13 of the contour dental chair. The neck cushion may be of the same thickness as that of the back cushion or of slightly greater thickness to provide full support for the back of the child's neck. Such a support is often necessary due to the immature neck muscles of very young children.

Figure 4:
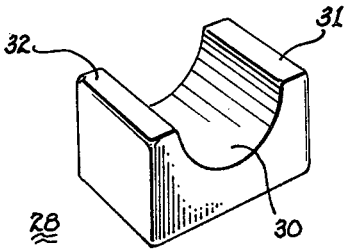
FIG. 4 is a perspective view of the headpiece.

Head rest 28 rests upon upper edge 29 of neck cushion 26 and is supported upon section 13. The head rest, as shown in FIGS. 4 and 5, includes a cylindrical depression 30 for receiving the rear of the child's head. The height at the center of the head rest is substantially less than that of neck cushion 26 to encourage backward tilting of the child's head while providing full and complete support therefor. As discussed above, such backward tilting encourages complete opening of the mouth and renders the oral cavity visually and physically accessible to the dentist. Side members 31 and 32 of the head rest bear against the sides of the child's head to preclude sideways rotation of the head. Additionally, the side members having resilient metal supports will cradle the head, regardless of size, to provide comfortable support and complement the feelings of security. The width of the head rest 28 is no more than necessary to accommodate the structural rigidity necessary for the side members. Thereby, the width of the head rest will not impede or otherwise derogate from rearward orientation of the hose supplying nitrous oxide and oxygen to the child. The height of side members 31 and 32 is maintained just sufficient to provide lateral support and yet not extend upwardly to a point whereat they would impede or preclude unrestricted motion of the dentist's hands and dental implements.

For very small children, neck cushion 26 may be eliminated such that head rest 28 is immediately adjacent upper edge 27 of back cushion 23. To maintain the neck cushion at the optimum location and maintain the child's head at a comfortable elevation, leg cushion 22, being of a thickness commensurate with the height of neck cushion 26, is placed upon seat cushion 21 to raise the child. Since the thicknesses of the back cushion is greater than that of the central section of the head rest at the bottom of depression 30, the child's head will also be maintained in a rearwardly tilted orientation.

Accordingly, the multi-segmental cushion assembly described above makes it possible to use effectively a contour dental chair with very young and diminutive children as well as older and larger sized children while retaining all of the benefits of a contour dental chair.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A removable multi-segment cushion assembly for adapting a contour dental chair to a child's physique which contour dental chair has a seat and leg support section and a back and head support section, said cushion assembly comprising in combination:

(a) a seat cushion supported by the seat and leg support section for elevating a child seated upon the contour dental chair;

(b) a back cushion for supporting the child's back, said back cushion being supported by the back and head support section and resting upon the rear edge of said seat cushion; and (c) a head rest for cradling the child's head, said head rest being supported by the back and head support section, said head rest including:

(1) a depression for receiving the back of the child's head, said depression being of a depth sufficient to encourage backward tilting of the child's head with respect to the child's shoulders; and (2) side members for precluding side-to-side rotation of the child's head about a pivot point at the rear of the child's head;

whereby, said cushion assembly elevates the child to a height comfortable for a dentist to perform his work and positions the child's head to encourage opening of the mouth at an orientation visually and physically accessible to the dentist.

2. The removable multi-segment cushion assembly as set forth in claim 1 wherein said head rest is of a lesser width than the width of the corresponding part of the back and head support section.

3. The removable multi-segment cushion assembly as set forth in claim 2 including a neck cushion supported by the back and head support section for supporting the child's neck, said neck cushion being positionable intermediate said back cushion and said head rest.

4. The removable multi-segment cushion assembly as set forth in claim 3 wherein said neck cushion is of greater thickness than the thickness of said head rest at the bottom of said depression.

5. The removable multi-segment cushion assembly as set forth in claim 4 wherein said neck cushion is of a lesser width than the width of the corresponding part of the back and head support section.

6. The removable multi-segment cushion assembly as set forth in claim 5 including a leg cushion supported by the seat and leg support section for supporting the child's legs and feet.

7. The removable multi-segment cushion assembly as set forth in claim 6 wherein the edge of said seat cushion upon which said back cushion rests includes an angled surface for providing vertical support to said back cushion.

8. The removable multi-segment cushion assembly as set forth in claim 7 wherein the edge of said seat cushion proximate the junction of the seat and leg support section and the back and head support section is an angled surface for avoiding interference between the junction and said seat cushion.

9. The removable multi-segment cushion assembly as set forth in claim 2 including a leg cushion supported by the seat and leg support section for supporting the child's legs and feet.

10. The removable multi-segment cushion assembly as set forth in claim 9 wherein the edge of said seat cushion upon which said back cushion rests includes an angled surface for providing vertical support to said back cushion.

11. The removable multi-segment cushion assembly as set forth in claim 10 wherein the edge of said seat cushion proximate the junction of the seat and leg support section and the back and head support section is an angled surface for avoiding interference between the junction and said seat cushion.

12. The removable multi-segment cushion assembly as set forth in claim 1 wherein said seat cushion includes an upper surface inclined downwardly toward the back and head support section.

* * * * *